US006599166B2

(12) United States Patent
Ellman et al.

(10) Patent No.: US 6,599,166 B2
(45) Date of Patent: Jul. 29, 2003

(54) METHOD AND DEVICE FOR CAUSING A TOY TO SIMULATE A CONDITION, SUCH AS YAWN OR SLEEP

(76) Inventors: Steven Ellman, 1672 E. 7th St., Brooklyn, NY (US) 11230; Lawrence Mass, 5 Berkley La., Rye Brook, NY (US) 10573; Fredric Ellman, 30 Fairview Ave., Tarrytown, NY (US) 10591; Julius Ellman, 1672 E. 7th St., Brooklyn, NY (US) 11230

( * ) Notice: Subject to any disclaimer, the term of this patent is extended or adjusted under 35 U.S.C. 154(b) by 83 days.

(21) Appl. No.: 09/842,814

(22) Filed: Apr. 27, 2001

(65) Prior Publication Data

US 2002/0160687 A1 Oct. 31, 2002

(51) Int. Cl.[7] ..... A63H 3/24

(52) U.S. Cl. ..... 446/300; 446/301; 446/343; 446/298

(58) Field of Search ..... 446/268, 295, 446/300, 301, 304, 337, 343, 351, 395, 297, 298

(56) References Cited

U.S. PATENT DOCUMENTS

| | | | | |
|---|---|---|---|---|
| 1,193,947 A | | 8/1916 | Trost | |
| 1,244,799 A | | 10/1917 | Trost | |
| 1,255,889 A | | 2/1918 | Killy | |
| 1,280,055 A | | 9/1918 | McCrosky | |
| 1,289,687 A | | 12/1918 | Davidson | |
| 1,343,422 A | | 6/1920 | Thomson et al. | |
| 1,395,984 A | | 11/1921 | McCrosky | |
| 1,545,077 A | | 7/1925 | Watkins | |
| 1,606,716 A | | 11/1926 | Munyard | |
| 1,729,729 A | | 10/1929 | McCrosky | |
| 2,093,684 A | | 9/1937 | Maibaum | |
| 2,133,636 A | | 10/1938 | Schaeffer | |
| 2,159,293 A | | 5/1939 | Schaeffer | |
| 2,197,764 A | | 4/1940 | Marcus | |
| 2,303,246 A | | 11/1942 | Wheeler | |
| 2,638,710 A | | 5/1953 | Ratcliff | |
| 2,813,372 A | | 11/1957 | Kirby | |
| 2,938,302 A | | 5/1960 | Walss | |
| 2,954,641 A | | 10/1960 | Washburn | |
| 2,974,265 A | | 3/1961 | Thoma | |
| 2,990,646 A | | 7/1961 | Berger | |
| 2,994,158 A | | 8/1961 | Washburn | |
| 3,310,908 A | | 3/1967 | Refabert | |
| 4,016,535 A | | 4/1977 | Dinlocker | |
| 4,708,689 A | | 11/1987 | Hou | |
| 4,740,186 A | | 4/1988 | Sirota | |
| 4,799,678 A | * | 1/1989 | Terzian et al. | 446/297 |
| RE33,933 E | | 5/1992 | Hou | |
| 5,422,628 A | | 6/1995 | Rodgers | |
| 5,842,902 A | * | 12/1998 | Liff | 446/130 |
| 5,941,750 A | | 8/1999 | Pracas | |
| 6,149,490 A | * | 11/2000 | Hampton et al. | 446/298 |
| 6,238,262 B1 | * | 5/2001 | Pracas | 446/301 |
| 6,322,420 B1 | * | 11/2001 | Daniellian | 446/300 |
| 6,371,826 B1 | * | 4/2002 | Pestonji | 446/298 |

* cited by examiner

*Primary Examiner*—Jacob K. Askun
*Assistant Examiner*—Faye Francis
(74) *Attorney, Agent, or Firm*—Dinesh Agarwal, P.C.

(57) ABSTRACT

A device for causing a toy to simulate a yawn or sleep condition, includes an actuator mounted in the toy which is pivotable between first and second positions when a stimulus is applied to the toy. A sensor is provided for detecting one of the first and second positions of the actuator. A microprocessor is operably connected to the sensor for receiving and storing signals from the actuator. The microprocessor counts the total number of signals and transmits an activation signal to the toy to simulate a yawn or sleep condition when the total number of signals detected by the sensor reaches a preset value.

33 Claims, 4 Drawing Sheets

METHOD AND DEVICE FOR CAUSING A TOY TO SIMULATE A CONDITION, SUCH AS YAWN OR SLEEP

FIELD AND HISTORICAL BACKGROUND OF THE INVENTION

The present invention is directed to toys, and more particularly a method and device for causing a toy to simulate a condition, such as yawn or sleep, when rocked by a user.

The prior art is replete with a variety of toys. The industry has been very active in responding to the needs and desires of children to produce an extensive variety of toys. Among many categories, there exists a line of toys that simulate various conditions or activities of children and adults. For example, many toys are presently available that open or close eyes to simulate awake or sleep conditions. Although these types of toys are attractive, children often like to emulate adult behavior. For example, children often play an adult by treating a toy, such as a doll, as a baby. Therefore, a toy that simulates yawn or sleep upon rocking, would be very useful for educational, as well as amusement purposes.

Examples of various toys are disclosed in U.S. Pat. Nos. 1,193,947; 1,244,799; 1,255,889; 1,280,055; 1,289,687; 1,343,422; 1,395,984; 1,545,077; 1,606,716; 1,729,729; 2,093,684; 2,133,636; 2,159,293; 2,197,764; 2,303,246; 2,638,710; 2,813,372; 2,938,302; 2,954,641; 2,990,646; 2,974,265; 2,994,158; 3,310,908; 4,016,535; 4,708,689; 4,740,186; 5,422,628; 5,941,750; and RE33,933.

BRIEF SUMMARY AND OBJECTS OF THE INVENTION

The principal object of the present invention is to provide a device that causes a toy to simulate a condition, such as yawn or sleep, when rocked by a user.

Another object of the present invention is to provide a device which causes a toy to simulate sleep or yawn condition when the toy is held in a substantially horizontal or recumbent position. In other words, the unique arrangement of the components prevents the toy to simulate yawn or sleep when held in a fully upright or substantially vertical position.

Yet another object of the present invention is to provide a device for a toy, which can sense a gentle to firm rocking motion through a range of toy's positions so that the toy simulates a yawn or sleep condition. In other words, the device compensates for a range of angles from the horizontal that a user may hold the toy and yet causes the toy to simulate a yawn or sleep condition.

An additional object of the present invention is to provide a device for causing a toy to simulate a yawn or sleep condition through a wide range of angles from the horizontal.

Yet an additional object of the invention is to provide a device which causes a toy to first simulate a yawn condition after rocking a predetermined number of times, and then fall asleep gradually. This arrangement provides a child with a heightened level of joy and experience.

In summary, the main object of the present invention is to provide a device for causing a toy to simulate a yawn or sleep condition which can sense a gentle to firm rocking motion through a wide range of the toy's positions from the horizontal.

In accordance with the present invention a device for causing a toy to simulate a condition, includes an actuator mounted in the toy which is pivotable between first and second positions when a stimulus is applied to the toy. A sensor is provided for detecting one of the first and second positions of the actuator. A microprocessor is operably connected to the sensor for receiving and storing signals from the actuator. The microprocessor counts the total number of signals and transmits an activation signal to the toy to simulate a yawn or sleep condition when the total number of signals detected by the sensor reaches a preset value.

In accordance with the present invention, a method of causing a toy to simulate a sleep condition, includes a) providing a toy with a device, including: a pendulum pivotable between first and second positions, the pendulum including a plurality of alternately spaced ON and OFF positions, a transmitter at each of said ON positions, a sensor for detecting a plurality of the ON positions, and a microprocessor for receiving and storing information about the ON positions, b) providing the toy with an eyes closing mechanism, c) holding the toy in a substantially horizontal position, d) rocking the toy in a side-to-side motion to thereby cause the pendulum to oscillate, e) detecting a plurality of ON positions of the pendulum by the sensor, f) transmitting a signal to the microprocessor for each ON position detected by the sensor, g) counting the number of ON positions to determine a total value and comparing the total value to a preset value by the microprocessor, h) transmitting an activation signal to the eyes closing mechanism if the total value of the ON positions is equal to the preset value, and i) gradually closing the eyes.

BRIEF DESCRIPTION OF THE DRAWINGS

The above and other objects, novel features and advantages of the present invention will become apparent from the following detailed description of the invention as illustrated in drawings, in which.

DETAILED DESCRIPTION OF THE INVENTION

Figure 6:
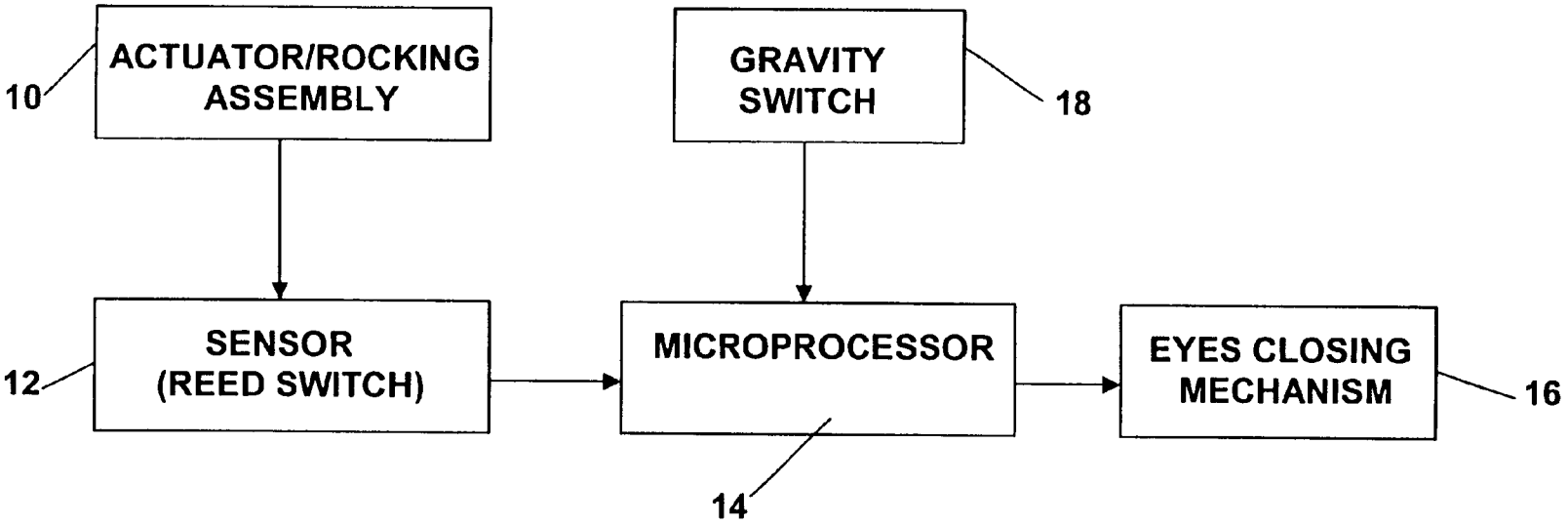
FIG. 6 is a block diagram showing various components of the device of the present invention.

As schematically shown in FIG. 6, the device D of the present invention includes an actuator or rocking assembly 10, a sensor 12 for detecting rocking motions from the assembly 10 and transmitting appropriate signals to a microprocessor 14, and a conventional eyes closing mechanism 16 for receiving signals from microprocessor 14 and causing the toy doll's eyes to close gradually. Preferably, a conventional gravity switch 18 is provided for detecting the orientation of the toy in vertical and horizontal positions.

Figure 1:
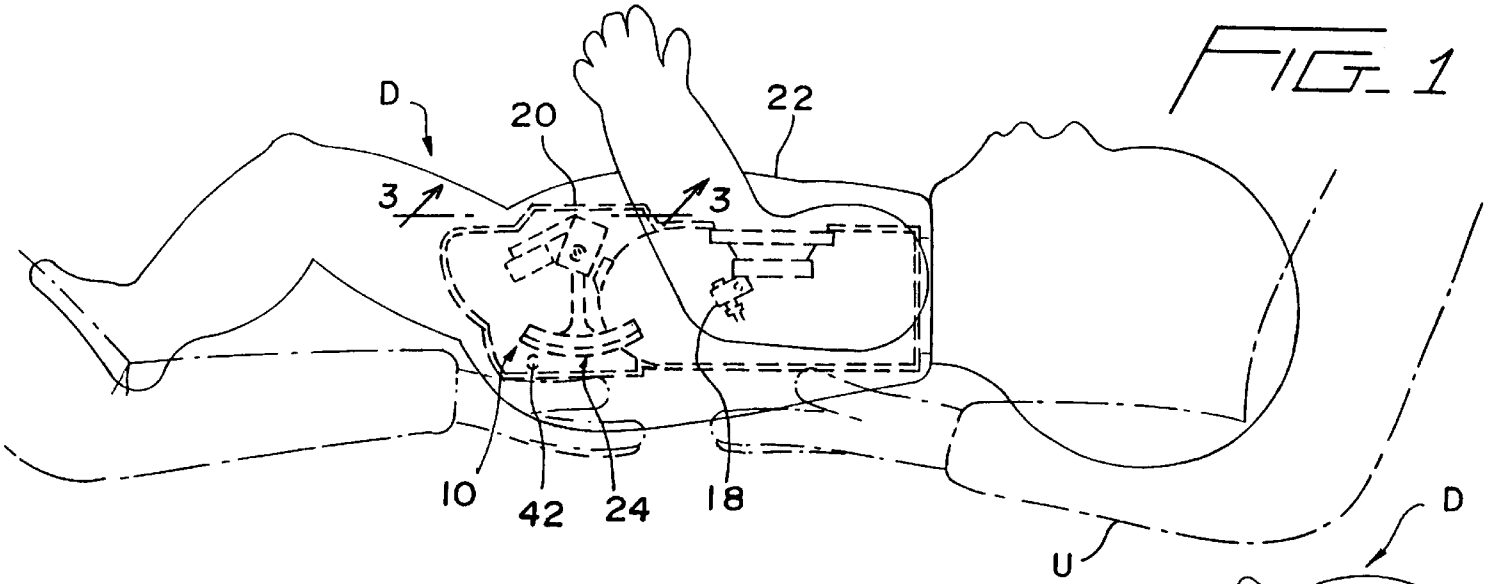
FIG. 1 shows a toy doll in a horizontal position held by a user, shown with the device of the invention positioned therein.
Figure 2:
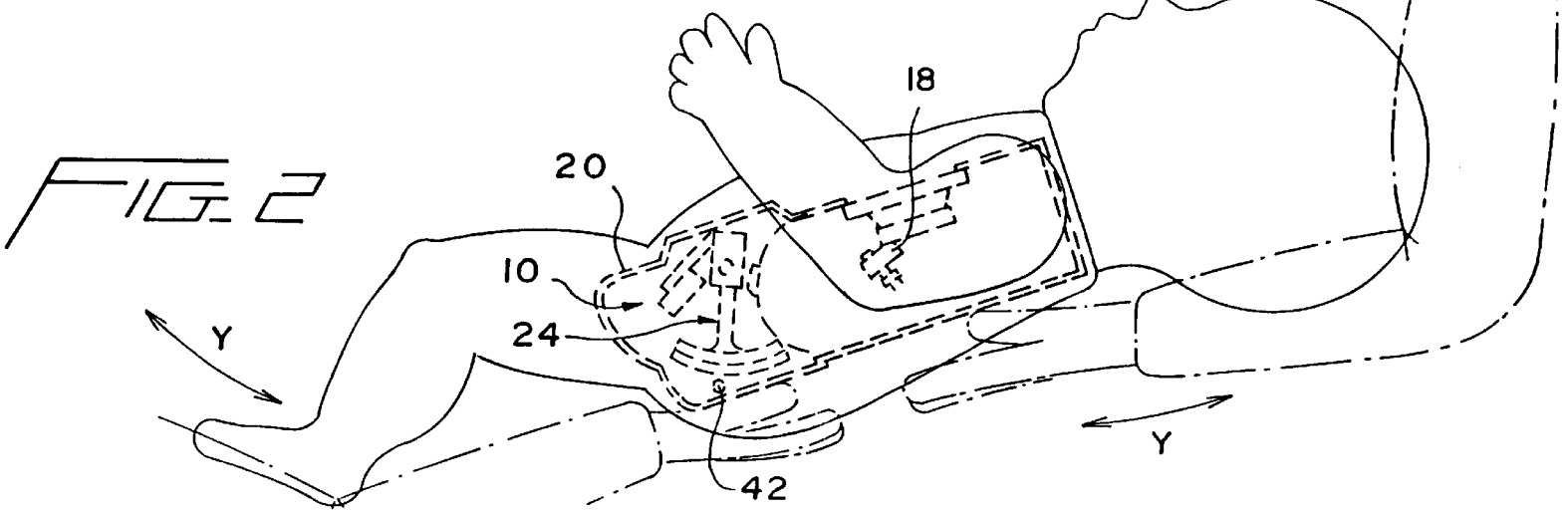
FIG. 2 is a view similar to FIG. 1, showing a rocking motion applied to the toy doll.

As shown in FIGS. 1–2, the rocking assembly 10 and gravity switch 18 are encased in a housing 20 positioned at an appropriate location inside a toy, such as a toy doll D, and preferably in the abdominal section 22 thereof.

Figure 3:
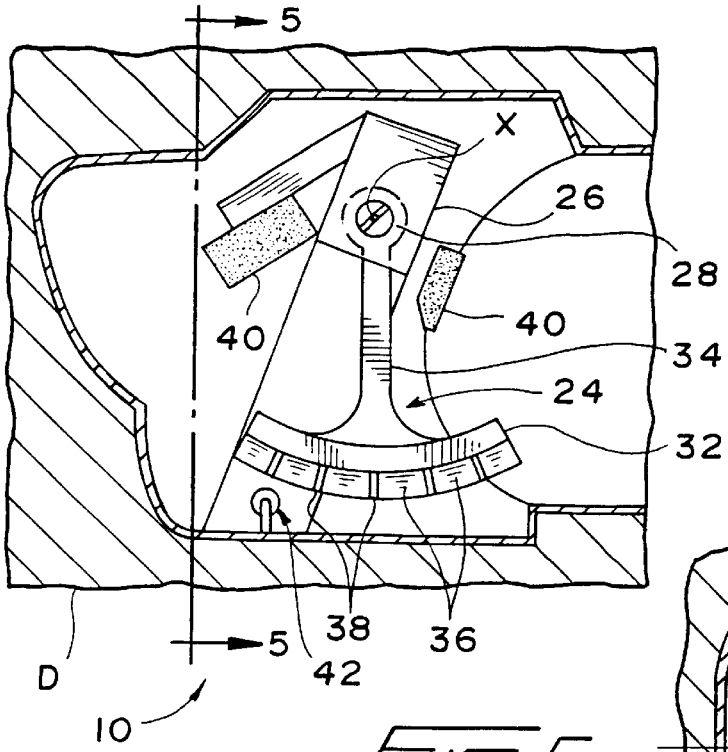
FIG. 3 is an enlarged sectional view of the toy doll taken along line 3—3 of FIG. 1, showing the device of the present invention.
Figure 5:
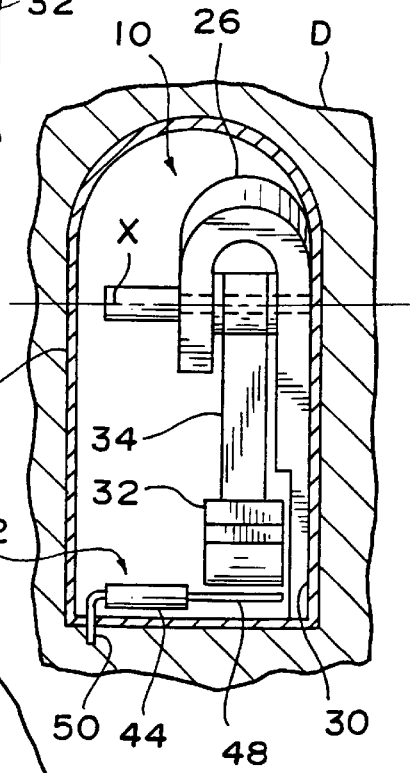
FIG. 5 is a sectional view taken along line 5—5 of FIG. 3.
Figure 4:
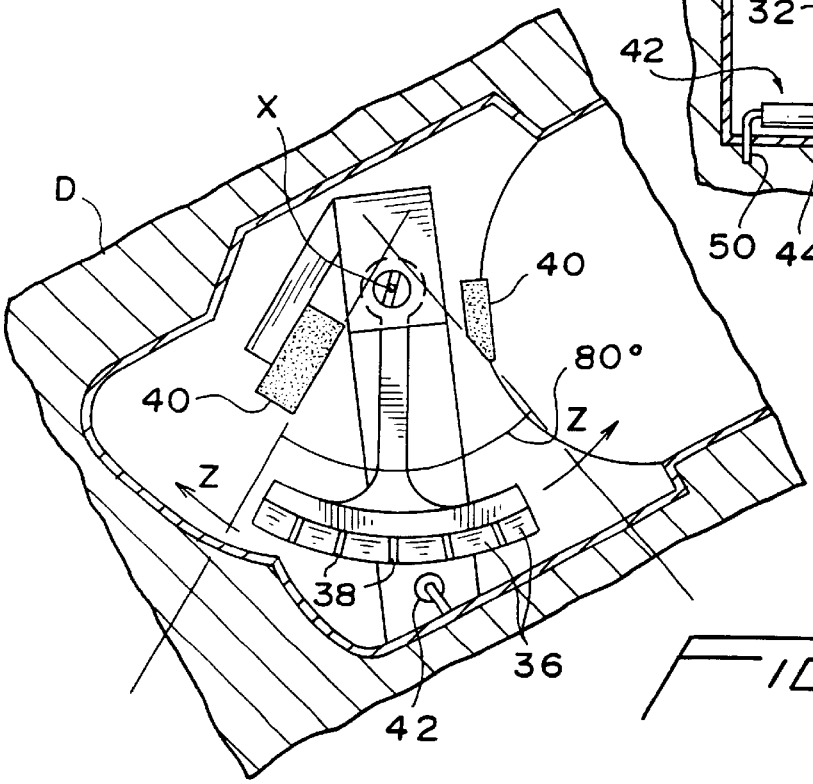
FIG. 4 is a view similar to FIG. 3, showing a position of the actuator upon rocking of the toy doll.

As best shown in FIGS. 3–5, the rocking assembly 10 includes an actuator or pendulum 24 pivotably suspended from a frame 26 by a pin 28. The frame 26, on the other hand, is mounted to an inside wall 30 of the housing 20. The pendulum 24 includes a bottom strip portion 32 connected to a vertically extending stem portion 34. Preferably, the strip portion 32 is slightly curved in the form of a segment of a circle concentric to the pivot point or axis X. The strip 32, preferably includes six magnetic members 36 that are spaced from each other by non-magnetic sections 38. Preferably, the strip 32 is a multi-pole flexible magnet strip with six segments of polarity 36, alternately spaced by non-magnetic sections 38. It is noted herewith that it is within the scope of this invention to provide individual metal or ceramic magnets set in separated segments as a substitute for the flexible multi-pole magnetic strip 32. It is also within the scope of this invention to vary the number, configuration, and locations of the magnets and non-magnetic sections. Also, while the invention has been illustrated by using magnetic members 36 to transmit signals to the microprocessor 14 representing angular movement of the pendulum 24, it is within the scope of the invention to use electrical, electromagnetic, or optical transmitters.

As shown in FIGS. 3 and 4, preferably padded stop members 40 are positioned on either side of the pendulum 24 to limit the swing or oscillation thereof to within a desired limit. Preferably, the pendulum 24 has an angular range of motion of up to about 80°. It is noted herewith that it is within the scope of the invention to vary this angle.

As best shown in FIG. 5, the sensor 12 preferably includes a reed switch 42 including a glass housing 44, and input and output metal lead 48 and 50, respectively. As best shown in FIG. 5, the glass housing 44 is laterally offset from the pendulum 24, such that the strip 32 swings over input metal lead 48. As the pendulum 24 swings over input metal lead 48, the magnets 36 open and close the reed switch 42, in a known manner.

As best shown in FIG. 3, the reed switch 42 is positioned laterally offset from the vertical position of the stem portion 34, when the doll D is lying horizontal. This arrangement provides a very effective braking (described below) of the pendulum 24 when the rocking motion is no longer applied to the doll D.

In order to prevent a continuous swinging motion of the pendulum 24 after a rocking motion or force is no longer applied by a user U, the device D of the present invention incorporates a braking system. In particular, the input and output metal lead 48 and 50 are preferably ferromagnetic. As a result, the strip 32 is attracted to the leads 48 and 50. Therefore, this arrangement functions as a magnetic damper or brake to the inertial motion of the pendulum 24. Without this arrangement, the pendulum 24 would be free to swing back and forth several times before finally coming to rest. With this brake, however, the pendulum 24 comes to rest quickly when the doll is no longer being rocked.

Although not shown, a power source, such as a battery, would be provided to provide sufficient electrical power for the reed switch 12, the microprocessor 14, and the gravity switch 18.

OPERATION

As noted above, when the doll D is held by a user U in a substantially horizontal position (FIG. 1), the magnetic brake arrangement will hold the pendulum 24 in a resting (stopped) position.

Figure 7:
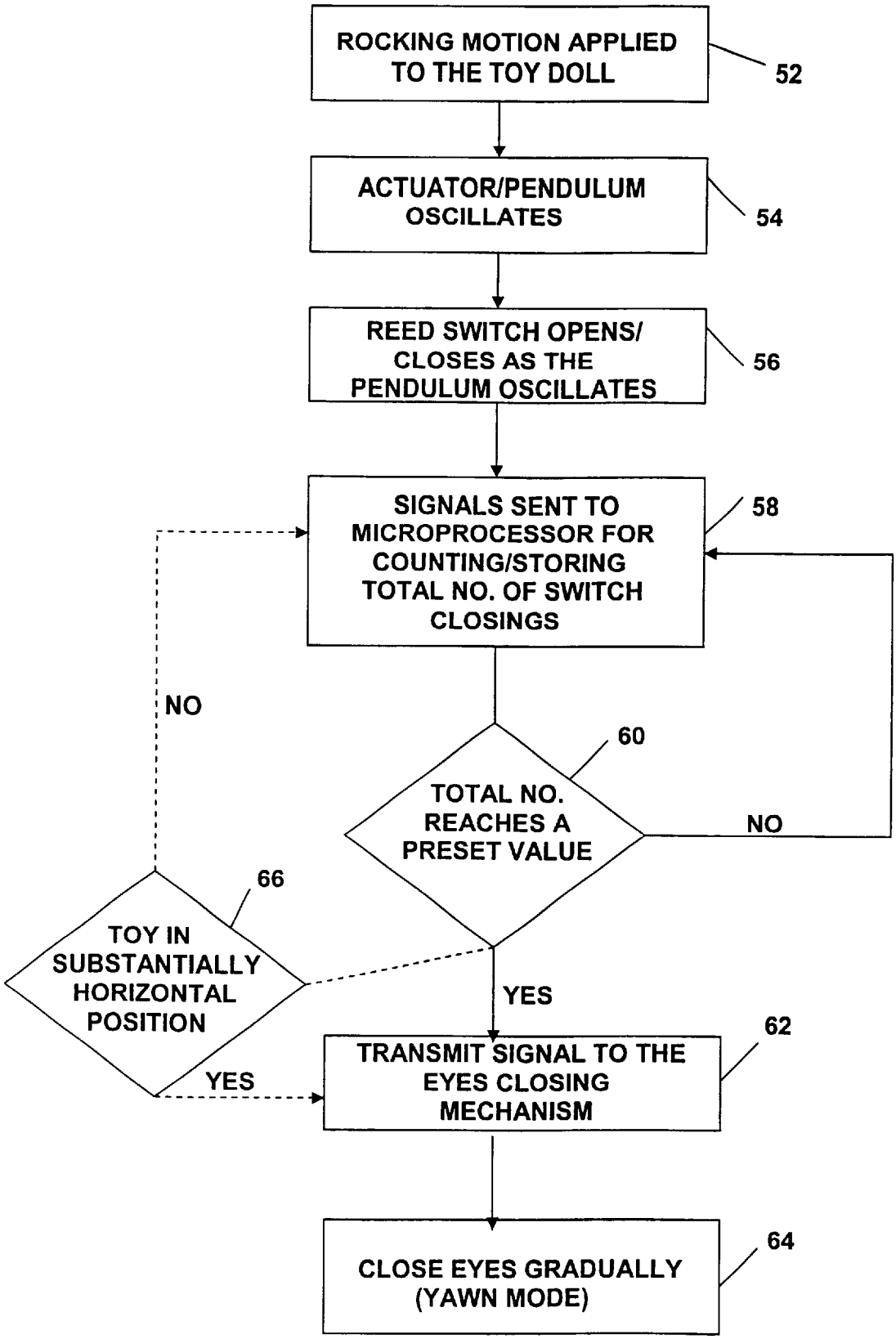
FIG. 7 is a flow-chart illustrating the sequence followed by the device of the present invention to cause the toy doll to simulate a yawn or sleep condition.

Referring now to FIG. 7, as the doll D is rocked (step 52) from left to right (shown by arrows Y in FIG. 2), the rocking motion would overcome the magnetic flux between the magnets 36 and the input and output leads 48 and 50, thereby allowing the pendulum 24 to swing left and right (step 54) (shown by arrows Z in FIG. 4). As the magnetic and non-magnetic members 36 and 38, pass over the input lead 48, the reed switch 42 will close (ON) and open (OFF) due to the magnetic flux from the magnets 36 (step 56). In each instance of the reed switch 42 closing, an electrical signal would be sent to the microprocessor 14 to assign a numerical value of 1 (step 58). As the reed switch 42 opens and closes, the microprocessor 14 will count and determine a total number for the switch closings (step 58). The microprocessor 14 would have been preprogrammed in a manner that when the total number of switch closings reaches a predetermined value (step 60), for example 3–20 or more, the microprocessor 14 will transmit an activation signal (step 62) to the eyes closing mechanism 16 to begin closing of the doll's eyes (step 64). This is the yawn mode which is followed by complete closing of the doll's eyes. Once the rocking motion Y is stopped by the user U, the magnetic flux between the magnets 36 and the input and output metal leads 48 and 50, would overcome the inertial movement of the pendulum 24 thereby bringing it to a stop or resting position quickly.

It is noted herewith that the microprocessor 14 may optionally be preprogrammed in a manner that if the doll D is not in a substantially horizontal position (step 66), no activation signal would be transmitted to the eyes closing mechanism 16, even if the total number of switch closings, as detected by the reed switch 42, reaches a predetermined value. This is to avoid having the doll D yawn and fall asleep when not in a substantially horizontal position. One such situation is possible in the event a user holds the doll D in a substantially vertical position and moves it up and down with a force sufficient enough to cause the pendulum 24 to oscillate.

The microprocessor 14 would further have been preprogrammed to transmit a signal to the eyes closing mechanism 16 to open the doll's eyes, when the doll D is returned to a substantially vertical position. In this situation, the pendulum 24 will come to rest against one of the stop members 40 and will have no effect.

It is noted herewith that the predetermined number of reed switch closings, that is required before transmitting an activation signal to the eyes closing mechanism 16, could be set higher than three in order to prevent accidental or fast closing of the eyes.

While this invention has been described as having preferred ranges, steps, materials, or designs, it is understood that it is capable of further modifications, uses and/or adaptations of the invention following in general the principle of the invention and including such departures from the present disclosure as those come within the known or customary practice in the art to which the invention pertains and as may be applied to the central features hereinbefore set forth, and fall within the scope of the invention and of the limits of the appended claims. It is further noted that the present invention is not limited to the appended claims.

What is claimed is:

1. A device for causing a toy to simulate a condition, comprising:

a) an actuator mounted in a toy;

b) said actuator being pivotable between first and second positions when a stimulus is applied to the toy;

c) said actuator including ON and OFF positions;

d) said ON position corresponding to said one of said first and second positions;

e) a transmitter at said ON position;

f) said transmitter comprising an electrical, a magnetic, an electromagnetic, or an optical transmitter;

g) a sensor for detecting one of said first and second positions of said actuator;

h) a microprocessor operably connected to said sensor for receiving and storing said one of said first and second positions of said actuator as a value;

i) said microprocessor counting one or more values to determine a total value; and j) said microprocessor transmitting a signal to the toy to simulate a condition when the total value reaches a preset value.

2. The device of claim 1, wherein:

a) said actuator including a plurality of alternately spaced ON and OFF positions.

3. The device of claim 2, wherein:

a) said actuator comprises an elongated member including a magnetic member at each of said ON positions.

4. The device of claim 3, further comprising:

a) a stop member positioned adjacent one of said left and right positions.

5. The device of claim 3, wherein:

a) said sensor comprises a switch that can be activated upon sensing a magnetic, electric, electromagnetic, or optical field.

6. The device of claim 5, wherein:

a) said switch comprises a reed switch.

7. The device of claim 6, wherein:

a) said reed switch includes a lead member; and b) said actuator comprises a pendulum oscillatable between left and right positions adjacent said lead member.

8. The device of claim 7, further comprising:

a) a brake for maintaining said pendulum member in a substantially stationary position.

9. The device of claim 8, wherein:

a) said lead member comprises a metal material; and b) said brake comprises said lead member and a magnetic member positioned at one of said ON positions.

10. The device of claim 7, wherein:

a) said pendulum oscillates toward either of said left and right positions by an angle of about 80°.

11. The device of claim 1, further comprising:

a) means for detecting the orientation of the toy in a substantially horizontal or substantially vertical position; and b) said microprocessor transmitting a signal to the toy to simulate a condition when the total value reaches the preset value and the device is not in a substantially vertical position.

12. The device of claim 1, wherein:

a) the toy simulates a yawn or sleep condition.

13. The device of claim 12, wherein:

a) the stimulus comprises rocking action applied to the toy by a user.

14. The device of claim 13, further comprising:

a) means operably connected to said microprocessor for causing the toy's eyes to close gradually.

15. The device of claim 12, wherein:

a) the preset value for a yawn condition comprises a numerical value of 3 or more.

16. The device of claim 12, wherein:

a) the preset value for a sleep condition is more than the preset value for a yawn condition.

17. A device for causing a toy to simulate a condition, comprising:

a) an actuator mounted in a toy;

b) said actuator being pivotable between first and second positions when rocked by a user;

c) said actuator comprising a plurality of alternately spaced ON and OFF positions;

d) a transmitter at each of said ON positions;

e) a sensor for detecting one of said ON positions;

f) a microprocessor operably connected to said sensor for receiving and storing information about said one of said ON positions;

g) said sensor transmitting a signal to said microprocessor upon detecting said one of said ON positions;

h) said microprocessor counting one or more signals to determine a total value; and i) said microprocessor transmitting an activation signal to the toy to simulate a condition when the total value reaches a preset value.

18. The device of claim 17, Wherein:

a) said sensor detects a plurality of said ON positions.

19. The device of claim 17, wherein:

a) said transmitter comprises a magnetic, an electrical, an electromagnetic, or an optical transmitter.

20. The device of claim 19, wherein:

a) said sensor comprises a reed switch with a lead member.

21. The device of claim 20, wherein:

a) said actuator comprises a pendulum oscillatable between said first and second positions adjacent said lead member.

22. The device of claim 21, wherein:

a) said pendulum oscillates toward either of said first and second positions by an angle of about 80°.

23. The device of claim 21, further comprising:

a) a stop member positioned adjacent one of said first and second positions.

24. The device of claim 23, further comprising:

a) a brake for maintaining said pendulum member in a substantially stationary position.

25. The device of claim 24, wherein:

a) said lead member comprises a metal material; and b) said brake comprises said lead member and a magnetic member positioned at one of said ON positions.

26. The device of claim 17, further comprising:

a) means for detecting the orientation of the toy in a substantially horizontal or substantially vertical position; and b) said microprocessor transmitting an activation signal to the toy to simulate a condition when the total value reaches the preset value and the device is not in a substantially vertical position.

27. The device of claim 21, wherein:

a) means operably connected to said microprocessor for causing the toy's eyes to close gradually upon receiving said activation signal.

28. The device of claim 27, wherein:

a) said preset value comprises a numerical value of 3 or more.

29. A device for causing a toy to simulate a yawn or sleep condition upon rocking by a user, comprising:

a) a pendulum member mounted in a toy;

b) said pendulum member for oscillating between first and second positions when the toy is rocked by a user;

c) said pendulum member comprising a plurality of alternately spaced ON and OFF positions;

d) a magnetic member at each of said ON positions;

e) a sensor for detecting a plurality of said ON positions as said pendulum member oscillates between said first and second positions;

f) a microprocessor operably connected to said sensor, for receiving and storing information about said ON positions;

g) said sensor, for detecting each said ON position, transmitting a signal to said microprocessor;

h) said microprocessor, for each said signal received, assigning a numerical value corresponding to number 1;

i) said microprocessor adding up said numerical values and storing as a total value in each instance of receiving a signal from said sensor;

j) said microprocessor comparing the total value to a preset value; and k) said microprocessor transmitting an activation signal to the toy to simulate a yawn or sleep condition when the total value reaches the preset value.

30. The device of claim 29, wherein:

a) said sensor comprises a reed switch with a lead member; and b) said pendulum member oscillates adjacent said lead member.

31. The device of claim 30, wherein:

a) the preset value for a yawn condition comprises a numerical value of 3 or more.

32. A method of causing a toy to simulate a sleep condition, comprising the steps of:

a) providing a toy with a device, comprising:

i) a pendulum pivotable between first and second positions;

ii) the pendulum including a plurality of alternately spaced ON and OFF positions;

iii) a transmitter at each of said ON positions;

iv) a sensor for detecting a plurality of the ON positions;

v) a microprocessor for receiving and storing information about the ON positions;

b) providing the toy with an eyes closing mechanism;

c) holding the toy in a substantially horizontal position;

d) rocking the toy in a side-to-side motion to thereby cause the pendulum to oscillate;

e) detecting a plurality of ON positions of the pendulum by the sensor;

f) transmitting a signal to the microprocessor for each ON position detected by the sensor;

g) counting the number of ON positions to determine a total value and comparing the total value to a preset value by the microprocessor;

h) transmitting an activation signal to the eyes closing mechanism if the total value of the ON positions is equal to the preset value; and i) gradually closing the eyes.

33. The method of claim 32, wherein:

the preset value comprises a numerical value of 3 or more.

* * * * *